US009758219B1

(12) United States Patent
Arote et al.

(10) Patent No.: US 9,758,219 B1
(45) Date of Patent: Sep. 12, 2017

(54) CLEAT ATTACHABLE DEVICE

(71) Applicants: Richard Arote, Lynbrook, NY (US); Robert Dickie, King City, CA (US); Shahram Nabavi, King City, CA (US)

(72) Inventors: Richard Arote, Lynbrook, NY (US); Robert Dickie, King City, CA (US); Shahram Nabavi, King City, CA (US)

(73) Assignee: Land A Line Holdings, LLC

( * ) Notice: Subject to any disclaimer, the term of this patent is extended or adjusted under 35 U.S.C. 154(b) by 0 days.

(21) Appl. No.: 15/069,207

(22) Filed: Mar. 14, 2016

(51) Int. Cl.
*B63B 21/04* (2006.01)

(52) U.S. Cl.
CPC ..... *B63B 21/045* (2013.01)

(58) Field of Classification Search
CPC ..... B63B 21/045
See application file for complete search history.

(56) References Cited

U.S. PATENT DOCUMENTS 2,900,689 A 8/1959 Pearson
3,507,243 A 4/1970 Brown
3,512,316 A * 5/1970 Parr ..... E04B 1/34321 52/262
4,095,548 A 6/1978 Bruner
4,488,502 A 12/1984 Girard
4,706,594 A 11/1987 Burns
5,230,295 A 7/1993 Shell
5,564,670 A 10/1996 Dysarz
6,155,191 A 12/2000 Weaver
6,168,160 B1 1/2001 DeOreo et al.
6,568,648 B1 5/2003 Ray
7,603,960 B1 * 10/2009 Perry ..... B63B 21/04 114/218
8,544,401 B2 * 10/2013 Arote ..... E02B 3/24 114/218
2004/0237867 A1 12/2004 Dunn
2008/0105800 A1 5/2008 Menning et al.

* cited by examiner

*Primary Examiner* — Stephen Avila
(74) *Attorney, Agent, or Firm* — Robert M. Schwartz; Alfred K. Dassler

(57) ABSTRACT

A cleat attachable device for attaching to a cleat having horns. The device includes a frame having a base end, a distal end opposite the base end, and lateral posts. The lateral posts are disposed opposite one another and are connected to one another at the distal end. The lateral posts each have a respective mounting plate with a longitudinal slot formed therein. A stud plate has an underside for resting on the cleat. The stud plate has two studs opposite the underside for receiving the mounting plates thereon and securing the frame to the cleat.

11 Claims, 12 Drawing Sheets

Detail A

CLEAT ATTACHABLE DEVICE

FIELD OF THE INVENTION

Background of the Invention

The invention relates to a device for attaching to a cleat, more specifically, to a frame device for assisting in attaching a docking line with a looped end.

Description of the Related Art

The present invention embodies a frame device for assisting in attaching a docking line with a looped end.

Horn cleats or devices for attaching lines are used generally on docks. Docks generally have a side which allows for a vessel to pull up and tie up to the dock. Horn cleats, well known in the art, are typically made of a metal and include two horns affixed to spars, an opening is typically present in the center of the cleat between the spars.

U.S. Pat. No. 6,155,191 to Weaver discloses a cleat bracket having a first end with a z-shape, which allows the bracket to be attached to the cleat. The bracket includes a straight portion having a hook for holding accessories such as a lantern. The bracket of Weaver is not suitable for assisting in placing a loop of a line around horns of the cleat.

U.S. Pat. No. 8,544,401 to Arote discloses a cleat attachable device having several embodiments. The embodiments include different constructions for setting the relationship of lateral posts relative to the ends of the horns of the cleat. A first embodiment shown in FIG. 1 of Arote discloses lateral posts that are fixed with respect to one another and have cross-members affixed between them that sets a distance of the lateral sides of the lateral posts.

SUMMARY OF THE INVENTION

It is accordingly an object of the invention to provide a cleat attachable device which overcomes the above-mentioned disadvantages of the heretofore-known devices of this general type and which provides a device for assisting in attaching a docking line with a looped end, which is easy-to-use and easy to assemble.

With the foregoing and other objects in view there is provided, in accordance with the invention a cleat attachable device for attaching to a cleat having horns, the device having a frame having a base end, a distal end opposite the base end, and lateral posts, the lateral posts being disposed opposite one another and being connected to one another at the distal end, the lateral posts each having a respective mounting plate with a longitudinal slot formed therein, a stud plate having an underside for resting on the cleat, the stud plate having two studs opposite the underside for receiving the mounting plates thereon and securing the frame to the cleat.

In accordance with another feature of the invention, the stud plate has opposing sidewalls, inner sides of the sidewalls have a profile that corresponds to a profile of a corresponding cross section of the cleat.

In accordance with a further feature of the invention, each of the sidewalls have a respective hole formed therein in a position that corresponds to an opening of the cleat for receiving a bolt to secure the stud plate to the cleat In accordance with an added feature of the invention, the mounting plates each have bosses for attaching to a respective one of the lateral posts.

In accordance with an additional feature of the invention, the mounting plates each have a respective shoulder on an underside thereof for abutting against an end of a horn of the cleat.

In accordance with another mode of the invention, the cooperating clamp plates each having a respective top surface and a sidewall extending from the top surface, the top surface having two slotted openings spaced apart at the distance of the studs, the slotted openings permitting the clamp plates to be positioned on the studs with each respective sidewall abutting against the cleat.

In accordance with a further mode of the invention, each sidewall has a tab for engaging an opening in the cleat when each respective sidewall abuts against the cleat.

In accordance with an additional mode of the invention, the mounting plates each have bosses for attaching to a respective one of the lateral posts.

In accordance with still a further mode of the invention, the mounting plates each have a respective shoulder on an underside thereof for abutting against an end of a horn of the cleat.

Other features which are considered as characteristic for the invention are set forth in the appended claims.

Although the invention is illustrated and described herein as embodied in a cleat attachable device, it is nevertheless not intended to be limited to the details shown, since various modifications and structural changes may be made therein without departing from the spirit of the invention and within the scope and range of equivalents of the claims.

The construction and method of operation of the device, however, together with additional objects and advantages thereof will be best understood from the following description of specific embodiments when read in connection with the accompanying drawings.

DESCRIPTION OF THE PREFERRED EMBODIMENTS

Figure 1:
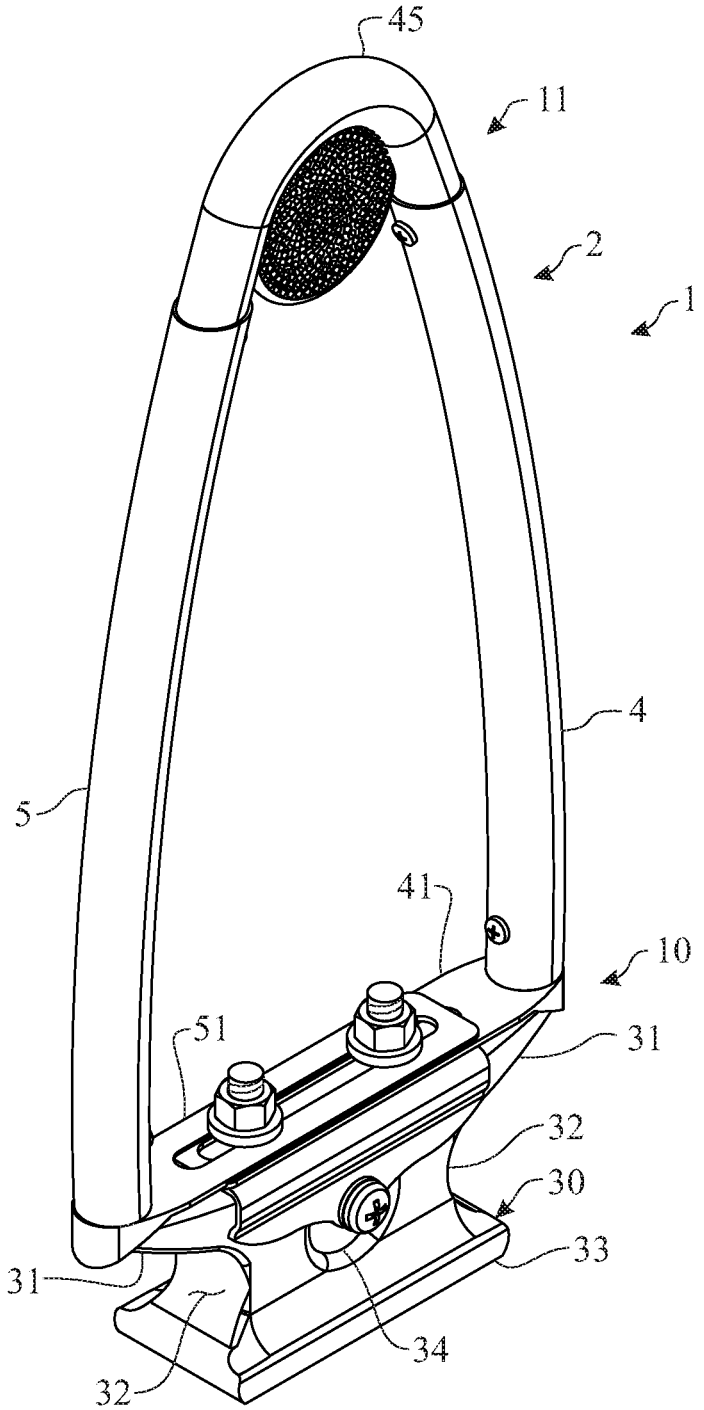
FIG. 1 is a perspective view of a first embodiment of the of the device mounted on a cleat.
Figure 2:
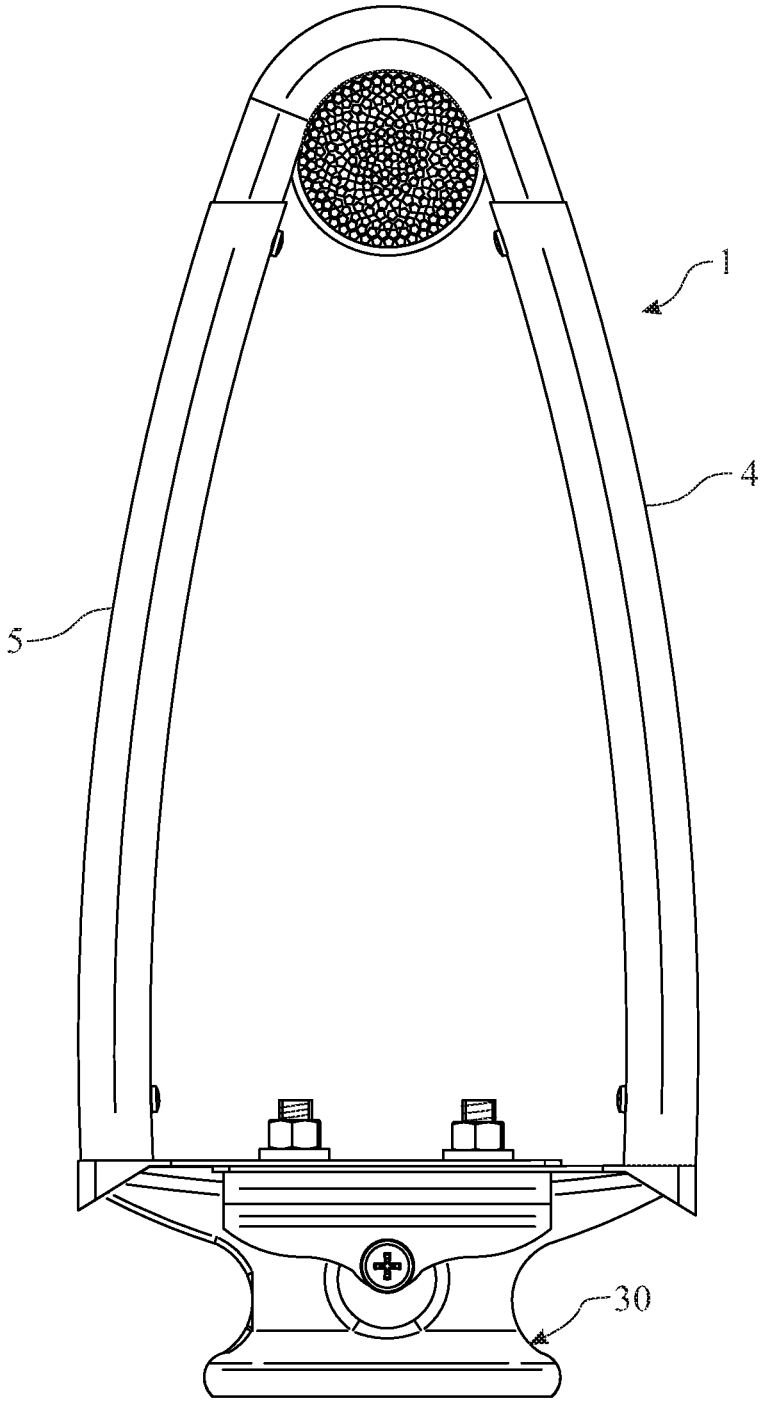
FIG. 2 is a side elevational view of the first embodiment of the device mounted on a cleat.
Figure 3A:
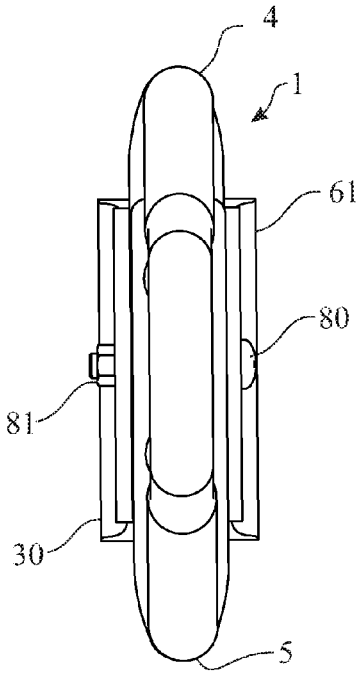
FIG. 3A is a top view of the first embodiment of the device mounted on a cleat.
Figure 3B:
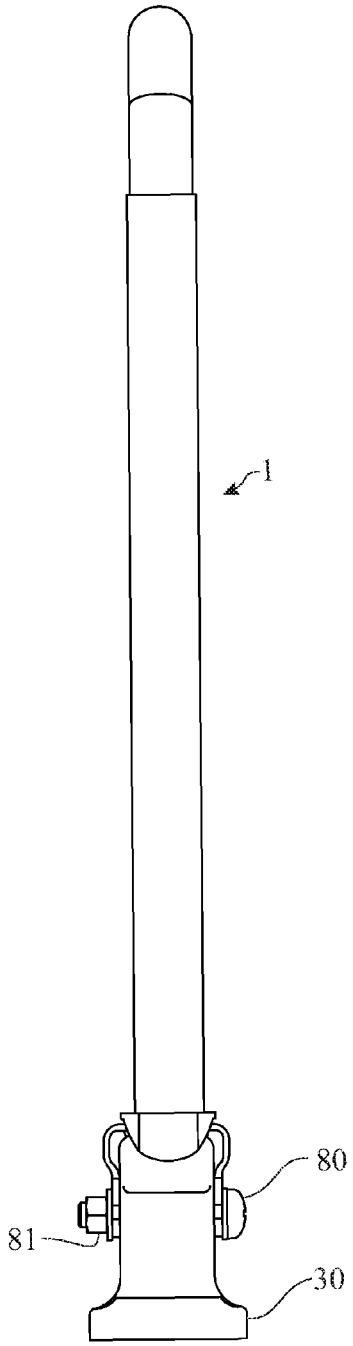
FIG. 3B is an end view of the first embodiment of the device mounted on a cleat.

Referring now to the figures of the drawing in detail and first, particularly, to FIG. 1 thereof, there is seen a cleat attachable device 1 having a frame 2. The device 1 is shown mounted on a cleat 30 which has horns 31, spars 32, a mounting foot 33 and opening 34 between the spars 32. The frame 2 includes lateral posts 4, 5 disposed opposite one another. The frame 2 has a base end 10 configured to be mounted to the cleat 30 and a distal end 11 opposite the base end 10. The lateral posts 4, 5 converge towards the distal end 11 and are attached to one another at the distal end 11 by a connection piece 45. The connection piece 45 may be provided as a curved piece to allow a loop 70 of a line 71 to easily pass over the distal end 11 and down the lateral posts 4, 5. The frame 2 has respective mounting plates 41, 51 mounted to said lateral posts 4, 5, at the base end 10. The mounting plates 41, 51 project towards one another and each has a respective end surface that matches the outer profile of the lateral posts 4, 5. This matching at the end surfaces prevents the line from becoming snagged at the transition between the mounting plates 41, 51 and the lateral posts 4, 5.

It is possible for the lateral posts 4, 5 to be provided as tubes and for the mounting plates 41, 51 to be provided with bosses 43, 53 which are received inside the tubes 4, 5. A mechanical fastener 49 may be provided for further securing the lateral posts 4, 5 to the bosses 43, 53. Alternatively, it is possible for the bosses 43, 53 to be provided as cups which receive the lateral posts 4, 5. In this case, it is preferable for the posts 4, 5 to have a step so that the outside diameter of the posts 4, 5 matches the outside diameter of the cups to prevent any possible snagging points.

The mounting plates 41, 51 are provided with respective slots 41*s*, 51*s* that are provided to attach the device 1 to the cleat 30. The slots 41*s*, 51*s* extend in a longitudinal direction of the mounting plates 41, 51 for setting a distance between the lateral posts 4, 5 (in the manner described below) to accommodate the length over the horns 31 of different size cleats 30. On an underside, each of the mounting plates 41, 51 is provided with a respective shoulder 42, 52. The shoulders 42 and 52 abut against the ends of the horns 31 and help to set the size of the frame 2 and assist in guiding the loop 70 over the horns 31 into a secure position on the cleat 30.

Figure 4:
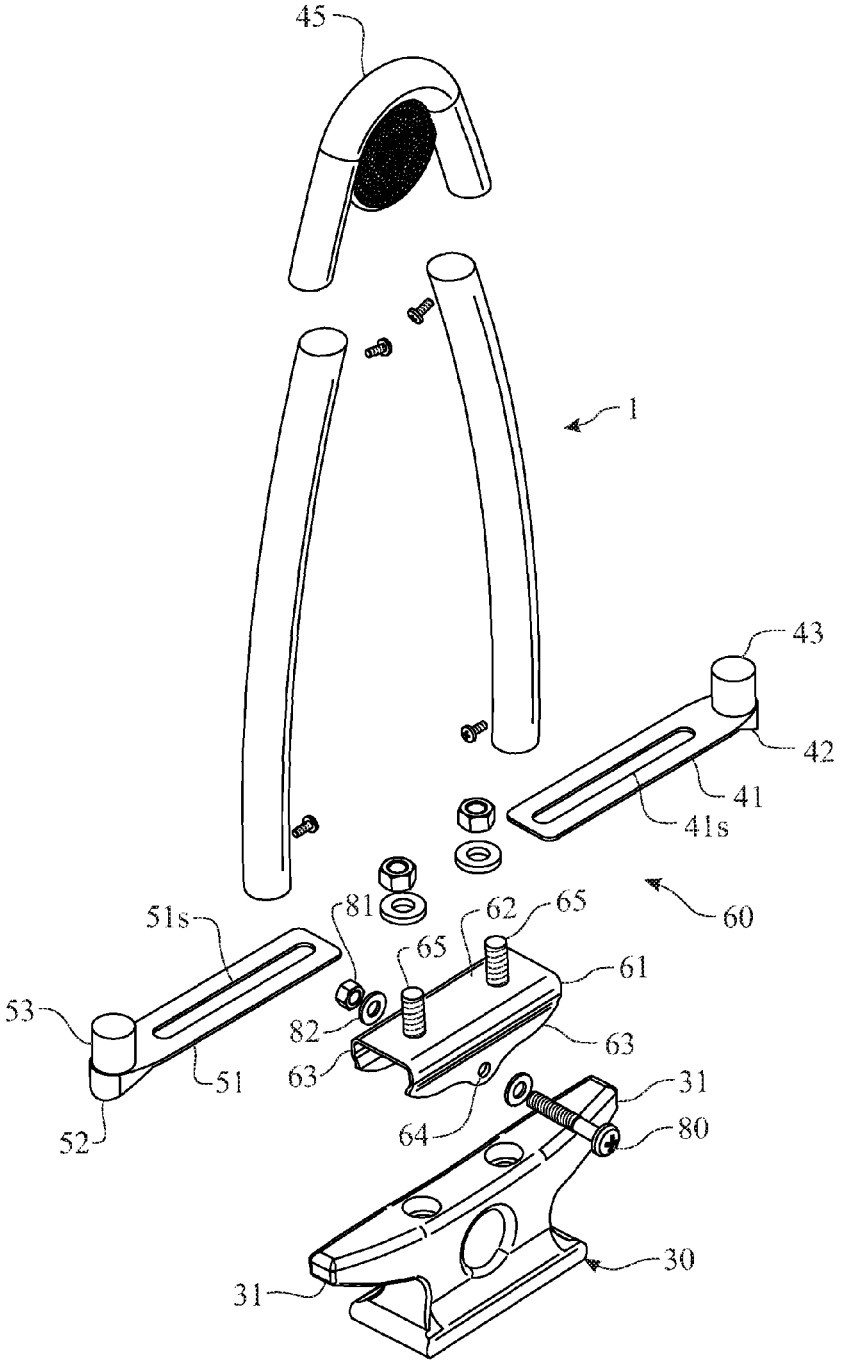
FIG. 4 is an exploded assembly of the first embodiment of the device in an unmounted state.
Figure 5:
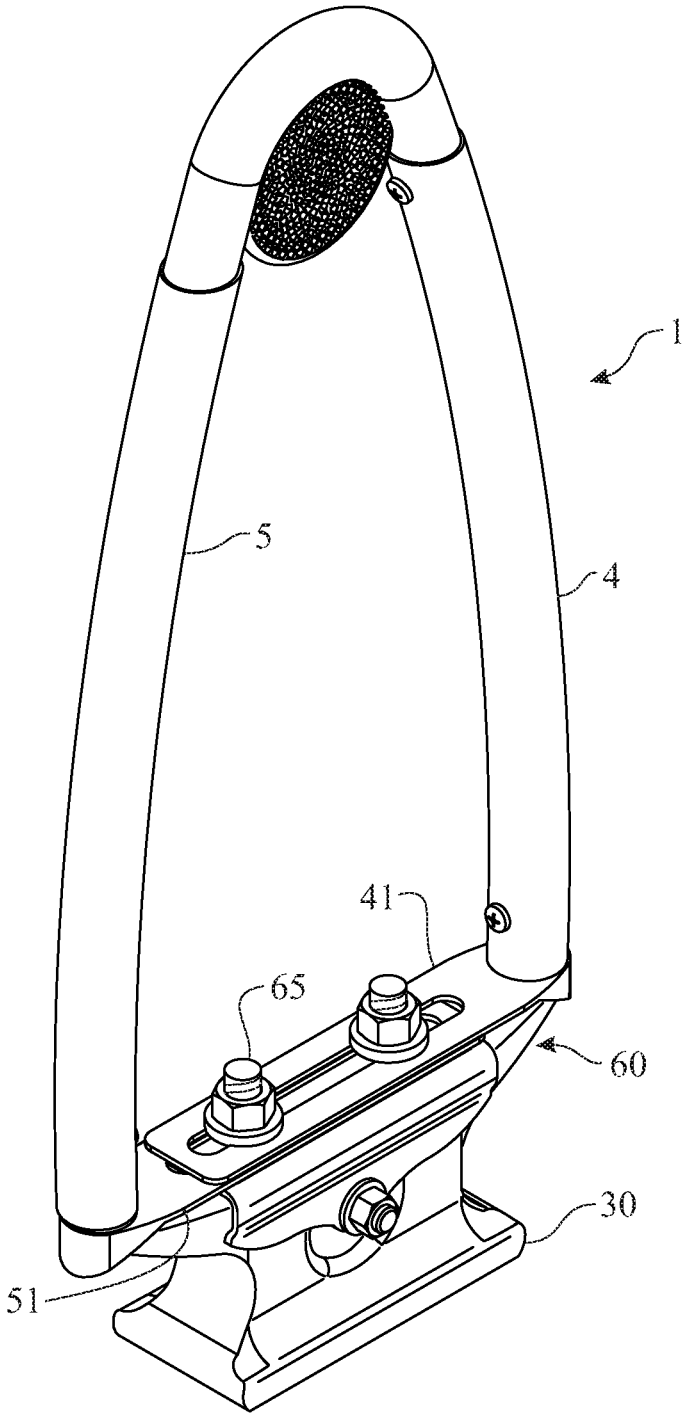
FIG. 5 is a perspective view of a second embodiment of the of the device mounted on a cleat.

The mounting plates 41, 51 are fixed to the cleat 30 by a bracket assembly 60. In FIG. 4, the bracket assembly 60 has a clamp plate/stud plate 61. The clamp plate 61 has a top surface 62 and opposing sidewalls 63 extending from the top surface 62. The sidewalls 63 are each provided with a respective holes 64 for accommodating a screw 80. The screw 80 passes through one of the holes 64 and then through the opening 34 of the cleat 30 and through the opposite hole 64, where it is then provided with a nut 81. It is also possible for washers 82 to be provided between the screw head and the corresponding sidewall 63 and between the nut 81 and the corresponding sidewall 63. Here, when considering a cross section of the clamp plate 61 an inner side of the sidewalls 63 has a profile that corresponds to the profile of a corresponding cross section of the cleat 30. There are two studs 65 projecting from the top surface 62 of the clamp plate 61. The studs 65 are aligned along a centerline of the top surface 62. The studs 65 receive the slots 41*s* and 51*s* of the mounting plates 41 and 51 and nuts 83 are threaded onto the studs 65 for securing the mounting plates 41 and 51 and thus the frame 2 to the cleat 30. In use, the plates 41 and 51 are placed over the studs 65 and the nuts 83 can be snugged down to a level that allows the mounting plates 41 and 51 to be moved toward one another until the inner sides of the shoulders 42, 52 abut the ends of the horns. Once set with the ends of the horns 31 are against the shoulders 42, 52, the nuts 83 are further tightened to firmly secure the frame 2 to the cleat 30.

Figure 6:
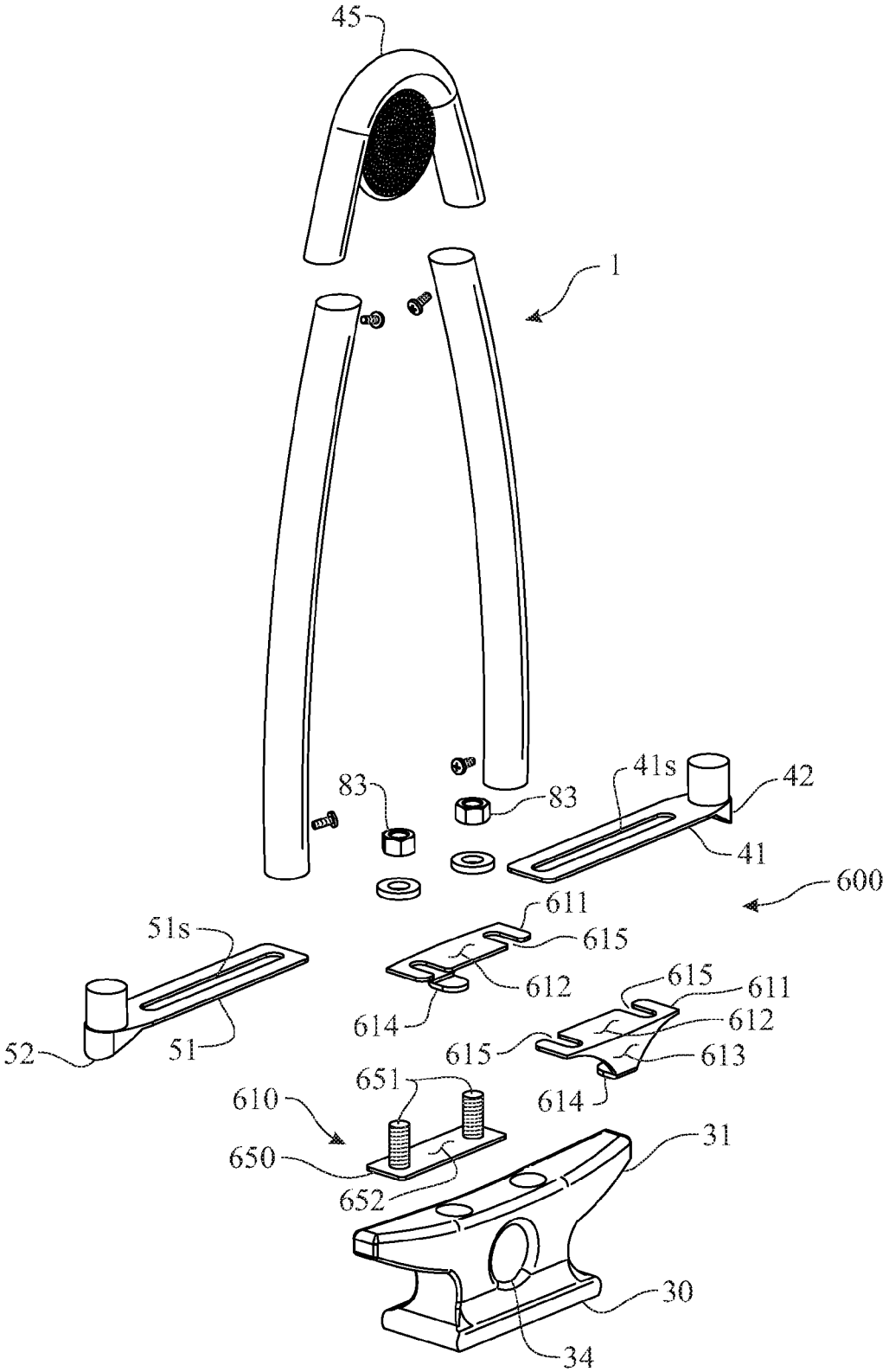
FIG. 6 is an exploded assembly of the second embodiment of the device in an unmounted state.
Figure 7:
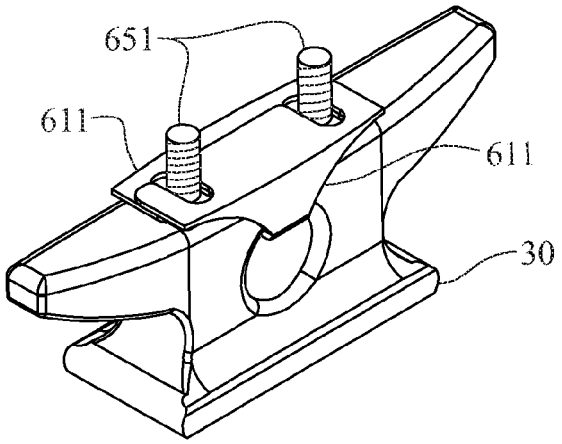
FIG. 7 is a perspective view from above of a portion of the device of the second embodiment on a cleat.
Figure 8:
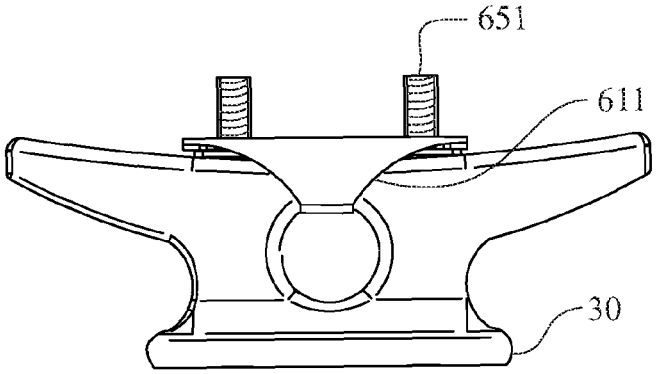
FIG. 8 is a side view of a portion of the of the device of the second embodiment on a cleat.
Figure 9:
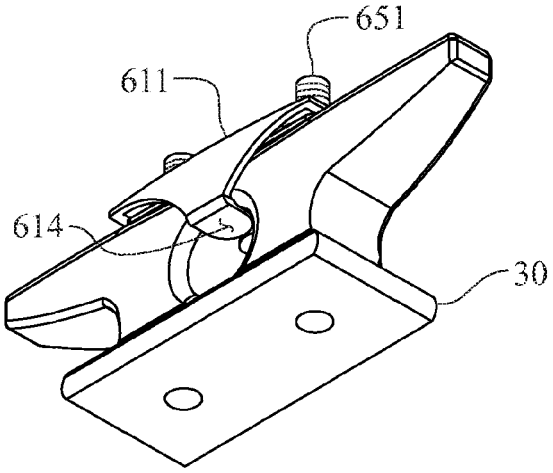
FIG. 9 is a perspective view from below of a portion of the device of the second embodiment on a cleat.
Figure 10:
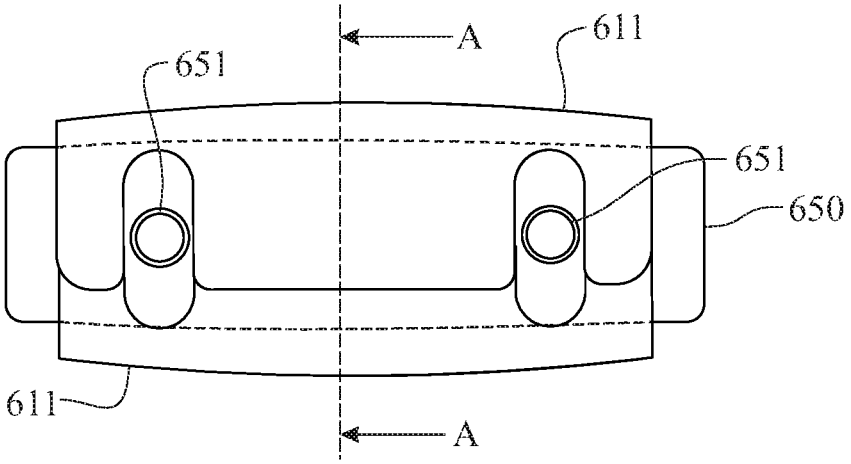
FIG. 10 is a top view of mounting components of the device of the second embodiment positioned in a position accommodating a smaller cleat.
Figure 11:
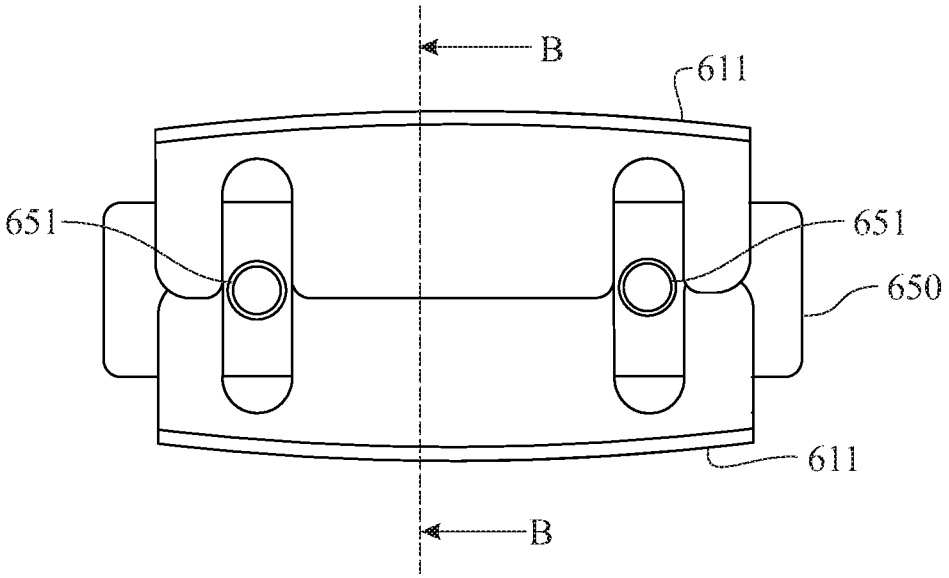
FIG. 11 is a top view of mounting components of the device of the second embodiment positioned in a position accommodating a larger cleat.

FIG. 6 shows a second embodiment of the cleat attachable device 1. Here, the mounting plates 41, 51 are fixed to the cleat 30 by a bracket assembly 600. In FIG. 6, the bracket assembly 600 has a clamp plate sub-assembly 610. The clamp plate sub-assembly 610 has cooperating clamp plates 611 each having a respective top surface 612 and a sidewall 613 extending from the top surface 612. The sidewalls 613 are each provided with a respective tab 614 opposite the top surface 612. The clamp plate sub-assembly 610 also includes a stud plate 650 with two studs 651 projecting from a top surface 652 of the stud plate 650. The studs 651 are aligned along a centerline of the top surface 652. The top surfaces 612 of the clamp plates 611 are each provided with two respective slotted openings 615, which are spaced apart at the distance of the studs 651. In use, the studs 651 receive the slotted openings 615 as well as the slots 41*s* and 51*s* of the mounting plates 41 and 51. Then the nuts 83 are threaded onto the studs 65 for securing the mounting plates 41 and 51 and thus the frame 2 to the cleat 30. During mounting, clamp plates 611 and the plates 41 and 51 are placed over the studs 65 and the nuts 83 can be snugged down to a level that allows the mounting plates 41 and 51 to be moved toward one another until the inner sides of the shoulders 42, 52 abut the ends of the horns. The clamp plates 611 can be pushed towards one another such that the tabs 614 are pushed into the opening 34 of the cleat and the sidewalls 613 are pressed against the cleat 30. This allows the clamp plate sub-assembly 610 to accommodate cleats of different widths. Once set, the sidewalls 613 clamp the cleat there between and the ends of the horns 31 are against the shoulders 42, 52, the nuts 83 are further tightened to secure the frame 2 to the cleat 30.

Figure 12:
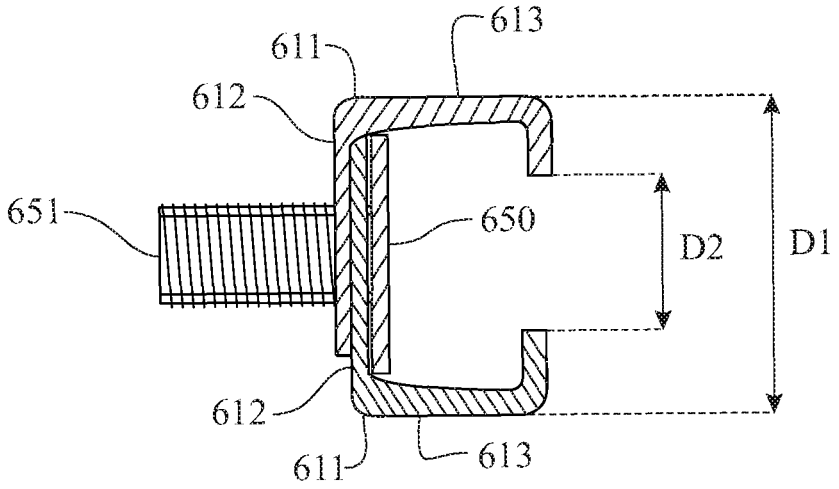
FIG. 12 is a section view of FIG. 10 along A-A with the cleat omitted.
Figure 13:
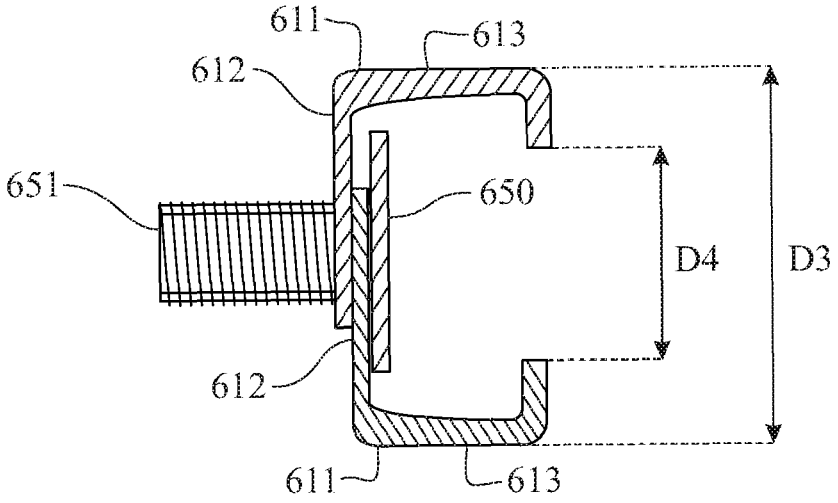
FIG. 13 is a section view of FIG. 11 along B-B with the cleat omitted.
Figure 14:
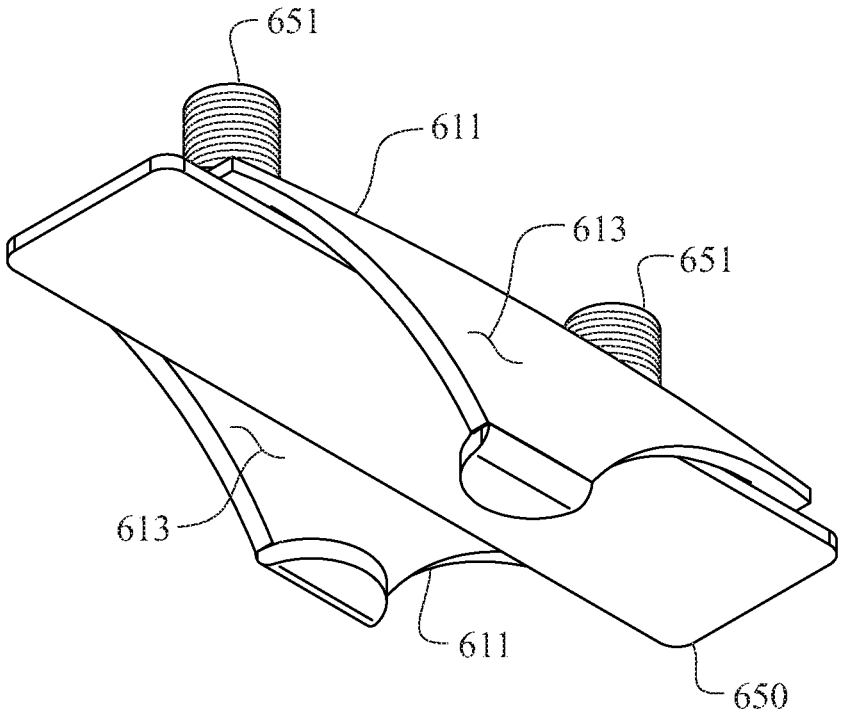
FIG. 14 is a perspective view of an underside of the mounting components of the device with the cleat omitted.

FIGS. 12 and 13 show the top surfaces 612 with varying overlap to accommodate different cleat thicknesses of different size cleats 30. These figures also show the stack up of the elements, namely that the stud plate 650 abuts the cleat 30 and then the clamp plates 611 are placed on top of the stud plate 650. Not shown, is the mounting plates 41, 51 would follow.

Figure 15:
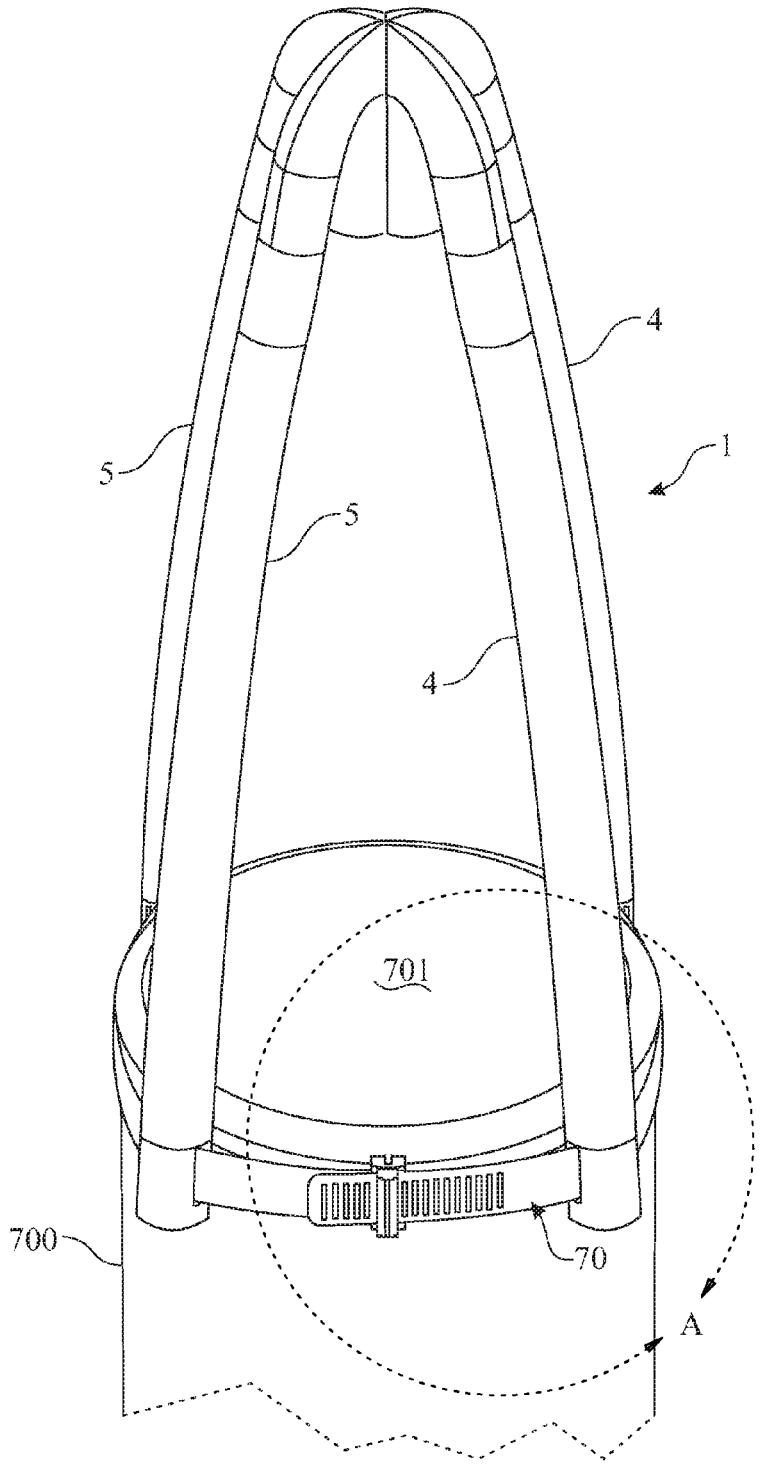
FIG. 15 is perspective view of a third embodiment of the of the device for mounting on a piling.
Figure 16:
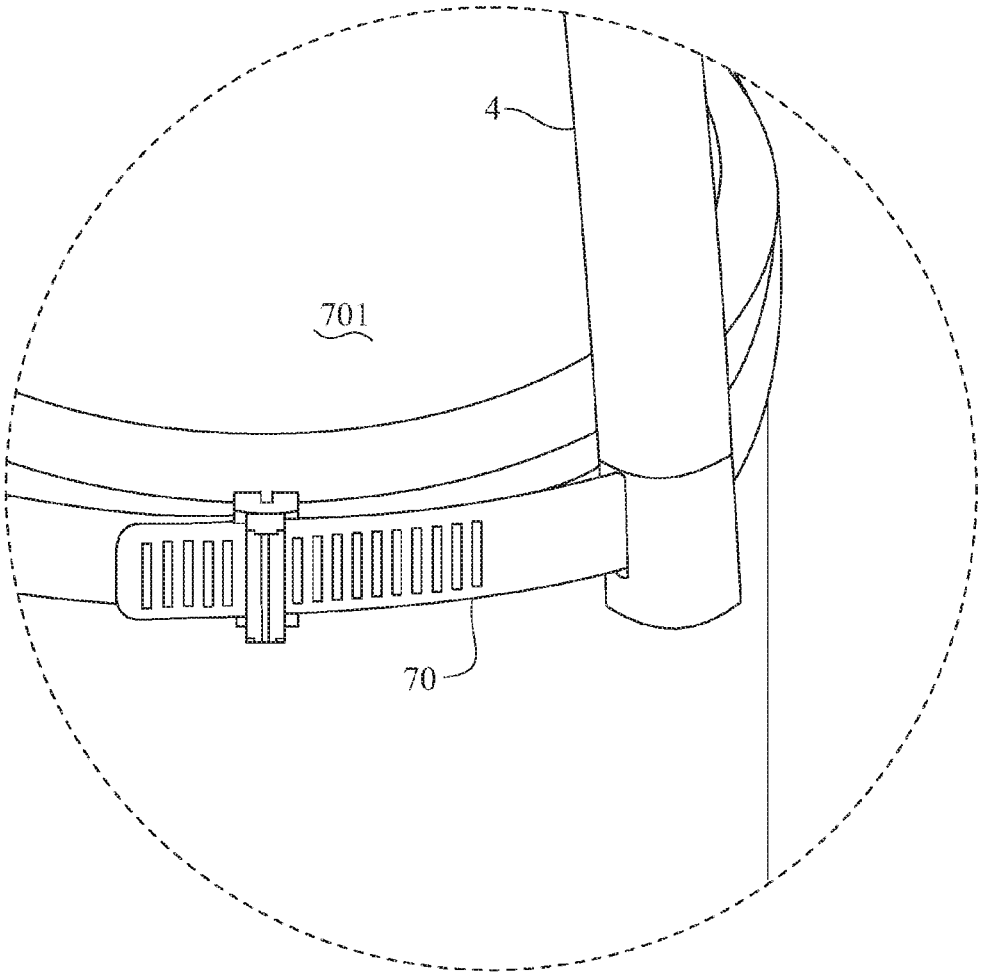
FIG. 16 is an enlarged view of detail A of FIG. 15.

FIGS. 15 and 16 show another embodiment of the device 1, which provides for mounting the device 1 to a piling 700. Here, there are at least three lateral posts and the base ends 10 of the lateral posts are provided with a slot for receiving a screw clamp 70 which allows the lateral post to be tightened down onto a dock piling 700 having a top surface 701.

We claim:

1. A cleat attachable device for attaching to a cleat having horns, the device comprising:

a frame having a base end, a distal end opposite said base end, and lateral posts, said lateral posts being disposed opposite one another and being connected to one another at said distal end, said lateral posts each having a respective mounting plate with a longitudinal slot formed therein;

a stud plate having a top surface and an underside for resting on the cleat, said stud plate having two studs opposite said underside and projecting from the top surface for receiving said mounting plates thereon and securing said frame to the cleat.

2. A cleat attachable device for attaching to a cleat having horns, the device comprising:

a frame having a base end, a distal end opposite said base end, and lateral posts, said lateral posts being disposed opposite one another and being connected to one another at said distal end, said lateral posts each having a respective mounting plate with a longitudinal slot formed therein;

a stud plate having an underside for resting on the cleat, said stud plate having two studs opposite said underside for receiving said mounting plates thereon and securing said frame to the cleat said stud plate has opposing sidewalls, inner sides of said sidewalls have a profile that corresponds to a profile of a corresponding cross section of the cleat.

3. The cleat attachable device according to claim 2, wherein each of said sidewalls have a respective hole formed therein in a position that corresponds to an opening of said cleat for receiving a bolt to secure said stud plate to the cleat.

4. The cleat attachable device according to claim 3, wherein said mounting plates each have bosses for attaching to a respective one of said lateral posts.

5. The cleat attachable device according to claim 4, wherein said mounting plates each have a respective shoulder on an underside thereof for abutting against an end of a horn of the cleat.

6. A cleat attachable device for attaching to a cleat having horns, the device comprising:

a frame having a base end, a distal end opposite said base end, and lateral posts, said lateral posts being disposed opposite one another and being connected to one another at said distal end, said lateral posts each having a respective mounting plate with a longitudinal slot formed therein;

a stud plate having an underside for resting on the cleat, said stud plate having two studs opposite said underside for receiving said mounting plates thereon and securing said frame to the cleat; and cooperating clamp plates each having a respective top surface and a sidewall extending from said top surface, said top surface having two slotted openings spaced apart at the distance of the studs, said slotted openings permitting said clamp plates to be positioned on said studs with each respective said sidewall abutting against the cleat.

7. The cleat attachable device according to claim 6, wherein each said sidewall has a tab for engaging an opening in the cleat when each respective said sidewall abuts against the cleat.

8. The cleat attachable device according to claim 7, wherein said mounting plates each have bosses for attaching to a respective one of said lateral posts.

9. The cleat attachable device according to claim 8, wherein said mounting plates each have a respective shoulder on an underside thereof for abutting against an end of a horn of the cleat.

10. A cleat attachable device for attaching to a cleat having horns, the device comprising:

a frame having a base end, a distal end opposite said base end, and lateral posts, said lateral posts being disposed opposite one another and being connected to one another at said distal end, said lateral posts each having a respective mounting plate with a longitudinal slot formed therein;

a stud plate having an underside for resting on the cleat, said stud plate having opposing sidewalls, for securing said stud plate on the cleat, said stud plate having two studs opposite said underside for receiving said mounting plates thereon and securing said frame to the cleat.

11. The cleat attachable device according to claim 10, wherein each of said sidewalls have a respective hole formed therein in a position that corresponds to an opening of said cleat for receiving a bolt to secure said stud plate to the cleat.

* * * * *